United States Patent [19]

Aspri et al.

[11] Patent Number: 4,762,046

[45] Date of Patent: Aug. 9, 1988

[54] SOUND REVERBERATOR DEVICE FOR DETACHABLE CONNECTION TO THE STRINGS OF A STRING MUSICAL INSTRUMENT

[75] Inventors: Roberto Aspri; Claude Mauffette; Michel Dallaire, all of Montreal, Canada

[73] Assignee: Les Entreprises Roberto Aspri Ltee, Quebec, Canada

[21] Appl. No.: 62,836

[22] Filed: Jun. 16, 1987

[51] Int. Cl.[4] ..... G10D 3/02

[52] U.S. Cl. ..... 84/294; 84/297 R

[58] Field of Search ..... 84/294, 267, 296, 297 R, 84/300, 301, 291

[56] References Cited

U.S. PATENT DOCUMENTS 685,920 11/1901 Heck ..... 84/294
936,624 10/1909 Hale ..... 84/297 R
1,539,961 6/1925 Scott ..... 84/294

FOREIGN PATENT DOCUMENTS 965272 4/1975 Canada .

*Primary Examiner*—L. T. Hix
*Assistant Examiner*—Brian W. Brown

[57] ABSTRACT

A sound reverberator device for detachable connection to the strings of a string musical instrument which has strings tensioned over a bridge piece connected to the top wall of the sound box or the instrument. The reverberator comprises three spaced apart metal coil springs secured side-by-side at a common end to a spring support. A metallic string attachment member is secured to a free end of each of the springs. The attachment member has string engaging fingers for engaging a respective one of a pair of adjacent strings of the musical instrument. The attachment member further has a bridge abutment portion for contact with the bridge piece. When the reverberator is connected to the musical instrument, the springs are tensioned with the attachment member connected to the strings whereby vibrations imparted to the strings will be transmitted to the bridge piece and the associated spring. The spring will then vibrate and transmit its vibrations to the sound box through the bridge piece whereby to modify the tonality sound generated by the sound box.

25 Claims, 5 Drawing Sheets

SOUND REVERBERATOR DEVICE FOR DETACHABLE CONNECTION TO THE STRINGS OF A STRING MUSICAL INSTRUMENT

BACKGROUND OF INVENTION

1. Field of Invention

The present invention relates to a sound reverberator device which is detachably securable to the strings of a string musical instrument whereby the vibrations imparted to the strings will be transmitted to springs contained in the device with the spring vibration being transmitted into the sound box of the musical instrument through the bridge piece whereby to enhance the sound generated by the sound box.

2. Description of Prior Art

It is well known that in order to enhance the tonality of a sound box of a musical instrucment, to incorporate within the sound box a large spring which can respond to the vibrations of the strings of the musical instrument to give maximum resonnant effect and amplify and modify the tones generated by plucking, frictioning, stricking or otherwise vibrating the strings of the instrument. particular references made to U.S. Pat. No. 685,920 which describes this principle.

In Canadian Pat. No. 965,272 issued Apr. 1, 1975, there is described a modification of this sound enhancing principle in that large springs are secured to a frame to suspend the springs vertically above the strings of the instrument over the top wall of the sound box and at a location, in front of the bridge piece. A loop at the free end of the springs connect directly to two strings and vibrate with the strings to enhance the sound of the instrument. The device can be easily removed or disconnected if the original sound of the musical instrument is required. However, this device has many disadvantages, in that it is unsightly, it does not provide good attachment of the springs to the strings, it is difficult to install, is cumbersome, and also it provides obstruction to the area of the instrument where the user must place his hand to pluck or otherwise activate the strings to vibrate them.

SUMMARY OF INVENTION

It is a feature of the present invention to provide an improved sound reverberator device of the type disclosed in Canadian Pat. No. 965,272 and which substantially overcomes all of the above mentioned disadvantages.

Another feature of the present invention is to provide a sound reverberator device which is detachably connectable to the strings of a string instrument, which is not cumbersome, which is aesthetically pleasing, which is easy to install, and which greatly enhances the tonality of the sound emanating from the sound box of the instrument.

According to the above feature, from a broad aspect, the present invention provides a sound reverberator device for detachable connection to the strings of a string musical instrument having strings tensioned over a bridge piece connected to a top wall of the sound box of the instrument. The reverberator comprises three spaced-apart metal coil springs secured side-by-side at a common end to a spring support. A metallic string attachment member is secured to a free end of each of the springs. The attachment member has string engaging means for engaging a respective one of a pair of adjacent strings of the musical instrument. The attachment member further has a bridge abutment portion for contact with the bridge piece. Means is provided to tension the springs with the attachment member connected to the strings whereby vibrations imparted to the strings will be transmitted to the bridge piece and associated spring. The spring being vibrated by the associated strings, transmits its vibration to the sound box through the bridge piece whereby to modify the tonality of the sound generated by the sound box.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
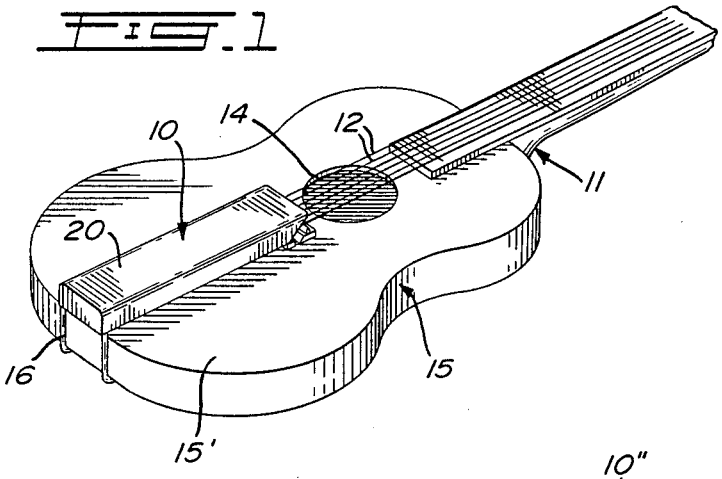
FIG. 1 is a perspective view of a string instrument to which is secured the sound reverberator device of the present invention.

Referring now to the drawings and more particularly to FIG. 1 there is shown generally at 10 the sound reverberator device of the present invention as secured to a string musical instrument, herein a classical guitar 11. As herein shown, the sound reverberator device 10 is connected to the strings 12 of the guitar and disposed rearwardly of the bridge piece 13 located rearwardly of the opening 14 of the sound box 15. The sound reverberator device 10 is secured to the strings 12, as will be described later and retained flat over the top wall 15' of the sound box by a clamp 16.

Referring now additionally to FIGS. 3 to 6, the sound reverberator of the present comprises essentially three, spaced-apart, metal coil springs 17 which are secured at a rear end 18 to a support, herein constituted by the rear wall 19 of the housing 20. A metallic string attachement member 21 is secured to a loop end 17' of the spring 17 at a forward end thereof and when not connected to the strings, abut against a front edge 23 of two dividing walls 22 disposed on each side of the center spring 17''. The walls 22 isolate the springs from one another. The housing 20 protects and conceals the springs and is preferably constructed of a plastic material and as herein shown, consists of a top wall 24, opposed side walls 25 and bottom wall 26. The front end 27 of the housing is opened for access to the springs and permit for the springs to be stretched. The springs 17 are normally tensioned between their front end and rear end connections although this is not essential as the tension can be adjusted by other means as will be described later.

Figure 6:
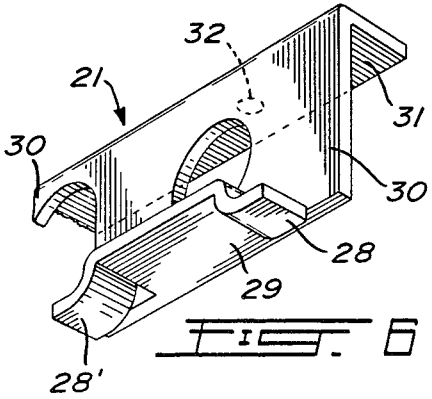
FIG. 6 is a enlarged fragmented view of one form of attachment ember.

The string attachment member 21, as more clearly shown in fragmented view in FIG. 6, is provided with a string engaging means in the form of two spaced-apart contact fingers 28 and 28' which are formed integrally at the free end of a bridge attachment portion 29. This bridge attachment portion 29 is a narrow rib dimensioned to fit between a pair of strings, in non-obstructing relationship thereto and projects from the bottom edge of a spring connecting wall or arm 30. This connecting arm 30 is connected and formed integral with a unitary spring connecting flange 31 provided with three spaced-apart holes 32 to which a respective one of the springs 17 is attached. Accordingly, there are three spring connecting arms 30 disposed side-by-side and depending from the spring connecting flange 31.

Figure 4:
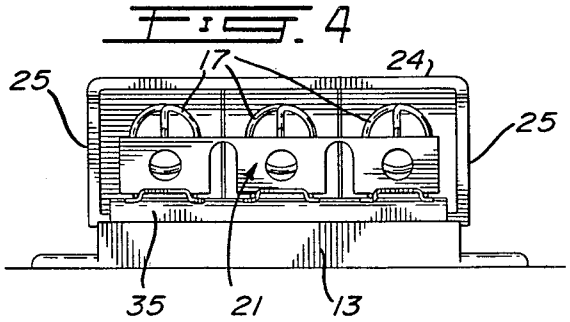
FIG. 4 is a front view of the sound reverberator device.

As seen more clearly in FIGS. 4 and 6, the fingers 28 and 28' depend downwardly from the bridge abutment portion and then are flared outwardly in opposed directions and in alignment with one another. When the sound reverberator device 10 is not in use, the spring connecting flange 31 is retained within a retention slot 23' formed within the front edge 23 of the dividing walls 22 and by the pulling force exerted by the tension in the spring 17.

Figure 2:
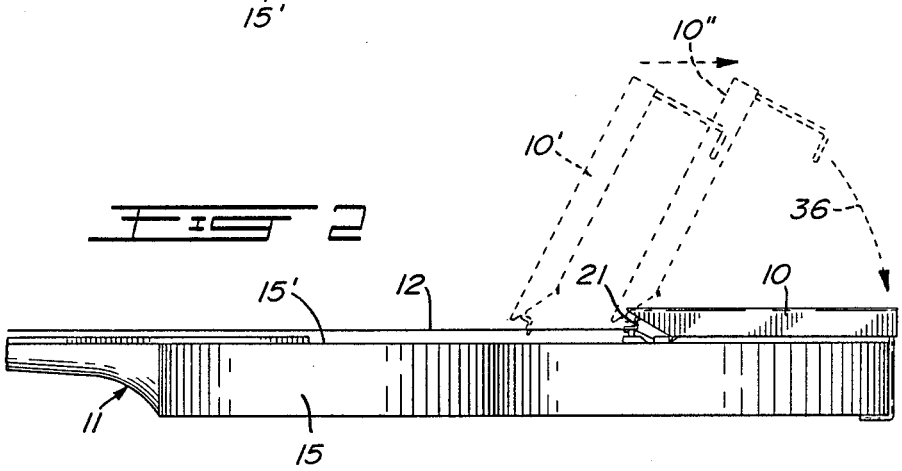
FIG. 2 is a side view of the sound instrument showing the manner in which the sound reverberator device of the present invention is installed.
Figure 3:
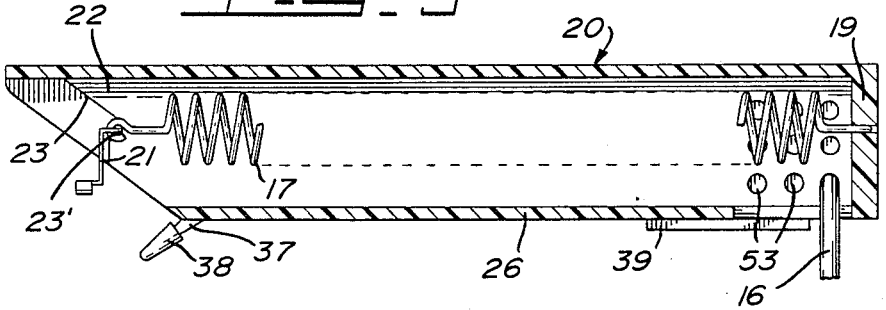
FIG. 3 is a elongated side section view of the sound reverberator device.
Figure 5:
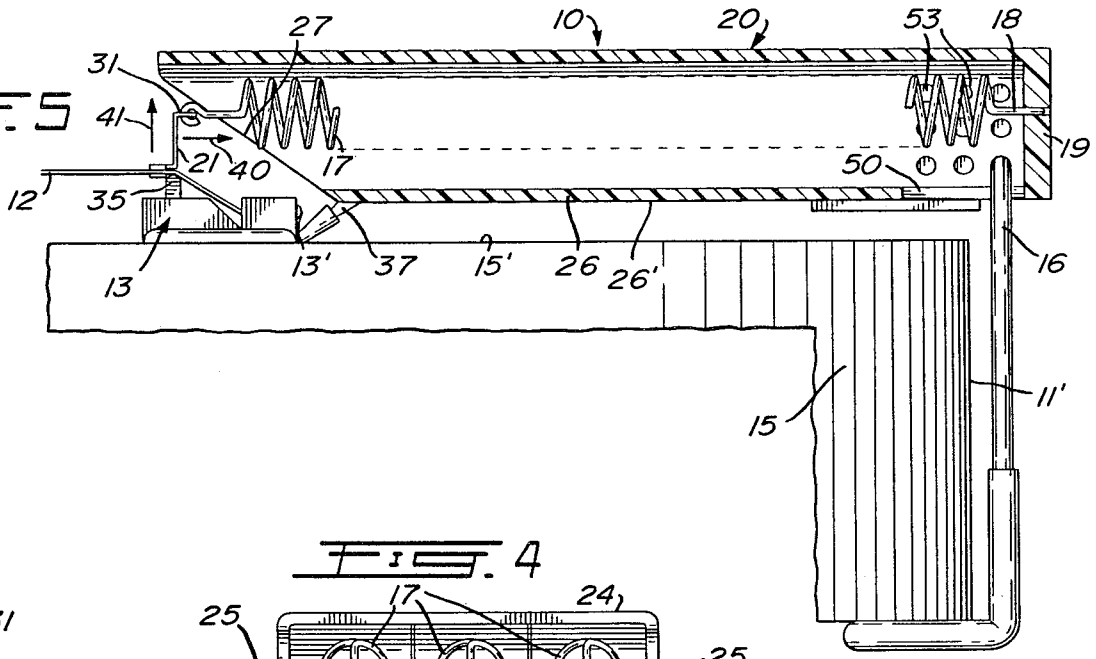
FIG. 5 is section of the sound reverberator device showing its installation on the top wall of the sound box of a musical instrument and its manner of attachment thereto.

Referring now more specifically to FIGS. 2, 4 and 5, there will be described the manner in which the sound reverberator device of the present invention is secured to the strings and the sound box of a string musical instrument such as the guitar 11. As shown in FIG. 2, the sound reverberator device is disposed substantially at the location as shown at 10' with the attachment member 21 extending diagonally over the strings whereby to position the contact finger 28 in the area between the strings. The housing 20 is then displaced to assume the position as shown at 10' with the bridge arm 29 extending between a respective pair 12' of the string 12 and the contact finger 28 located under a respective one of the strings of a pair 12'. The housing is then pulled back to the position as shown at 10'' in FIG. 2 and until the bridge abutment portion 29 is located above the string support bridge 35 of the bridge piece 13. This support bridge 35 is usually made from ivory material which is a good vibration conducting material. In this position, the contact fingers are disposed immediately in front of the string support bridge 35. As can be seen in FIG. 5, a pair of legs 37 depends angularly frontwards from a front edge of a bottom wall 26 of the housing 20 to support the housing 20 elevated from the top wall 15' of the sound box 15. These legs 37 also act as a wedge against the bottom rear edge 13' of the bridge piece 13. A rubberrized cover 38 is disposed over these legs at a free end thereof to prevent slippage of the housing. A rubber support pad 39 is also secured to the outer surface 26' of the bottom wall 26 to abut the top wall 15' of the sound box to also prevent slippage of the housing and maintains the housing elevated above the top wall 15' when the rear end portion of the housing 20 is disposed against this top wall 15'. This is not the case as shown in the installation of FIG. 5.

Figure 8:
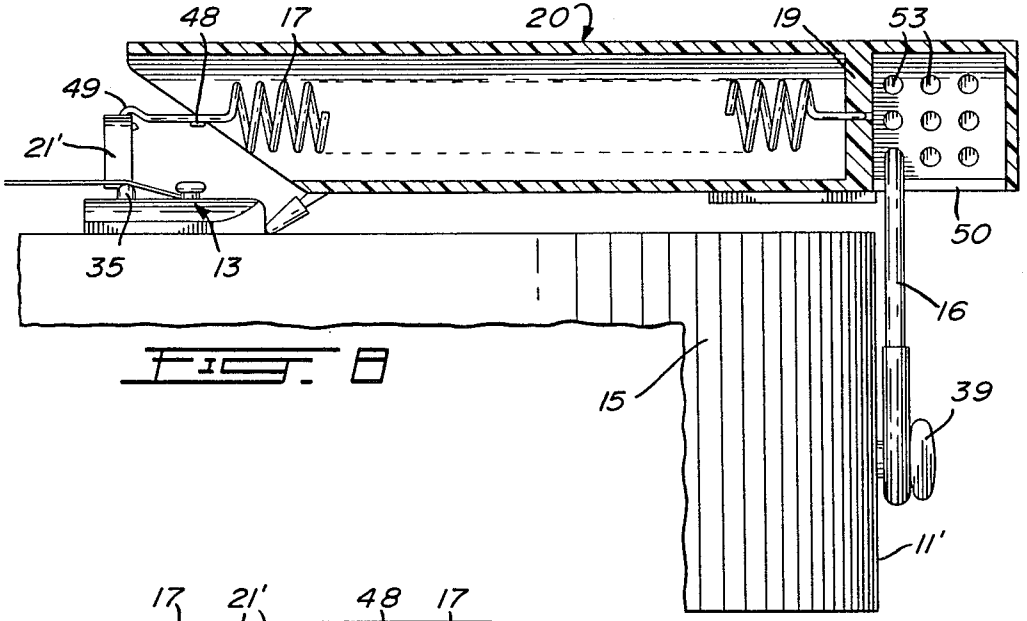
FIG. 8 is a fragmented side view of the sound box of a modified string musical instrument showing the sound reverberator device of the present invention as connected thereto by utilizing the attachment member of FIG. 7.

With the sound reverberator device 10 positioned at location 10'', as shown in FIG. 2, the housing is then drawn rearwardly and downwardly in the direction of arrow 36 and this causes the springs 17 to be stretched to their position as shown in FIG. 5 freeing the spring connecting flange 31 from its engagement with the slots 23' formed in the front edge of the dividing walls 22. The clamp 16 is then engaged with the rear end wall 11' of the musical instrument by either positioning the flange portion 16' of the clamp under the bottom wall 11'' of the housing or by attaching it to the knob 39 as secured the rear wall 11' of a western type guitar, as shown in FIG. 8. The clamp 16 as shown in FIG. 8 is of course shaped differently from that as shown in FIG. 2, but obvious to a person skilled in the art.

With the sound reverberator device 20 installed as shown in FIG. 5, the tension applied on the spring connecting flange 31, in the direction of arrow 40, imparts an upward force in the direction of arrow 41 onto the contact fingers 28 to provide good frictional contact with its associated strings 12. Thus, when a string 12 is plucked, it imparts a vibration which is transmitted to the sound box via the string support bridge 35 of the bridge piece 13 but this vibration is also transmitted to the spring 17 via the bridge abutment portion 29 and the spring connecting arm 30 and flange 31. The spring is thus set into vibration and this spring vibration is also transmitted back to the sound box 15 through the support bridge 35 and the bridge piece 13. This added vibration provides a resonant sound and amplify, give volume, prolong and further modify the tones usually generated by the vibrated string of the instrument.

Referring now to FIGS. 7 to 10, there is shown a modified version of the attachment member. As shown more clearly in FIG. 7, the attachment member, herein designated by reference numeral 21', is a generally u-shaped, narrow flat strip, member having opposed side arms 42 and 42' and a top intermediate integral top arm portion 43. A contact finger 44 is formed in a forward free edge portion of each of the side arms 42 and 42' by an outwardly extending integral flange which depends from the lower edge 45 to fit under the strings, as previously described with reference to contact fingers 28. The rear end edge 45 of each of the side arms 42 and 42', constitute the bridge abutment portion. The spring connecting arm is constituted by the side arms 42 and 42' and the top intermediate integral arm portion 43. This arm portion 43 is provided at its apex with a hole 46 centrally disposed therein for receiving a connecting loop end of an associated one of the springs 17.

Figure 9:
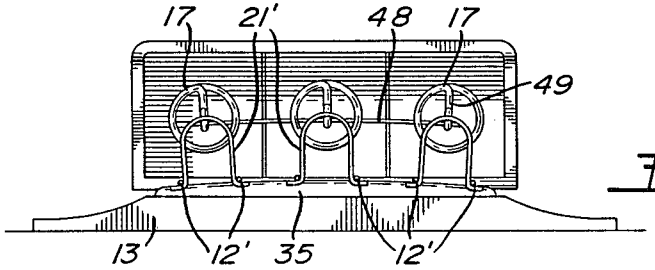
FIG. 9 is a front view of the sound reverberator device of FIG. 8 showing the attachment members secured to the strings of a western type guitar.
Figure 7:
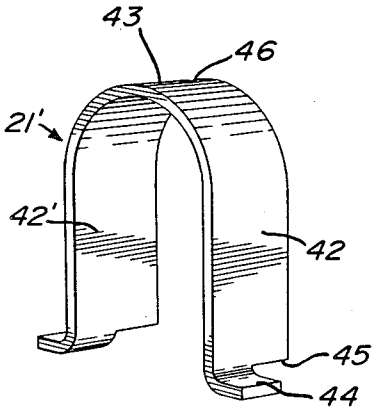
FIG. 7 is a perspective view of another form of the attachment member.
Figure 10:
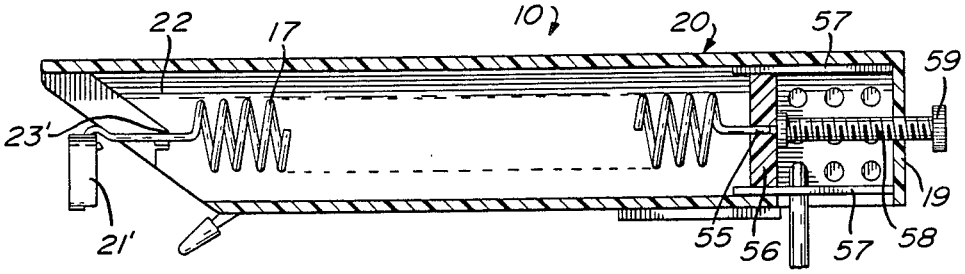
FIG. 10 is a elongated side section view of a modified sound reverberator device of the present invention.

As shown in FIGS. 8, 9 and 10, a connecting loop end of an associated one of the springs 17. As shown in FIGS. 8, 9 and 10, a connecting bar 48 is secured rearwardly of the loop ends 49 of the springs 17 to maintain the springs interconnected spaced-apart and to maintain the springs 17 under tension by locating the connecting bar 48 in the slots 23' of the dividing walls 22, as previously described with reference to FIGS. 3 to 5. The attachment members 21' are preferably for use with a western type guitare and it can be seen that these attachment members are individually connected to associated ones of the springs 17. They are secured to respective ones of pairs of strings 12' as more clearly shown in FIG. 9 and these are disposed over the string support bridge 35 of the bridge piece 13 in the manner as more clearly illustrated in FIG. 8.

Figure 11:
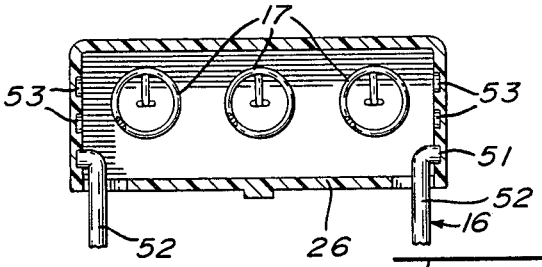
FIG. 11 is a partly fragmented end view showing the manner of adjustably securing the hinge clamp to the side walls of the housing.

As shown more clearly in FIGS. 5 and 11, the bottom wall 26 of the housing 20 is provided with an opening 50 in a respective rear corner thereof whereby to receive therein the pivoting end connection 51 of the clamping arm 52 of the clamp 16 for hingedly securing the hinge end 51 in a selected one of a plurality of cavities 53 formed in an inner surface of the side walls 25. This provides adjustment for the clamp 16 to fit musical instruments having sounding boxes 15 of different thicknesses. Also these cavities permit longitudinal adjustment of the clamp to adapt to sound box 15 having different lengths from the rear edge 13' of the bridge piece 13 to the rear wall 11' of the sound box 15.

Referring now to FIG. 10, there is shown another modification of the sound reverberator device 10 in that the springs 17 are connected at their inner ends 55 to a displaceable connecting wall 56 which is guided in a transverse plane between opposed guiderails 57. This wall 56 is displaceable by a threaded bolt 58 extending through the rear wall 19 of the housing 20 and axially rotatable by a knob 59. By rotating the bolt 58, the position of the wall 56 is displaced and the tension on the spring 17 is also varied whereby to adjust the tonality of the sound. This knob 59 thus acts as a fine tuning adjustment to vary the tonality of the reverberation of the sound which is generated by the vibration in the springs 17.

Figure 12:
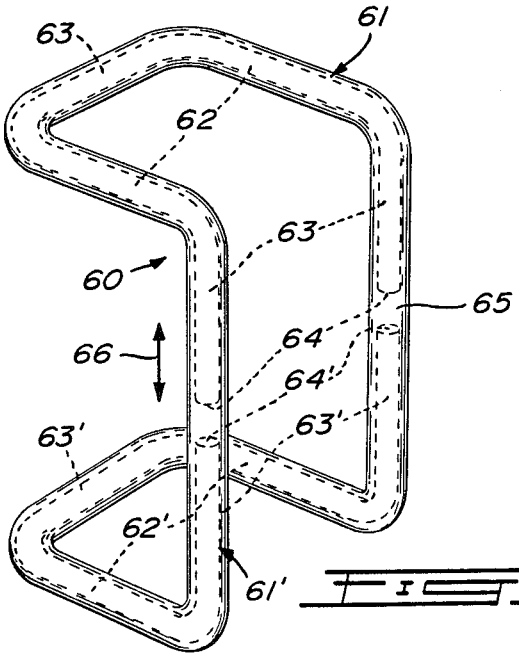
FIG. 12 is a perspective schematic view showing the construction of a further embodiment of a hinge clamp.
Figure 13:
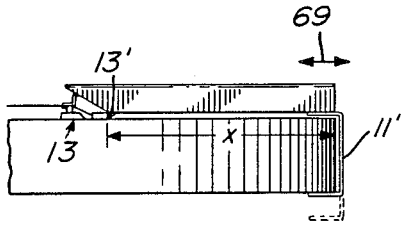
FIG. 13 is a side view showning the housing secured to a sound box of a string musical instrument utlizing the hinge clamp of FIG. 12.
Figure 14:
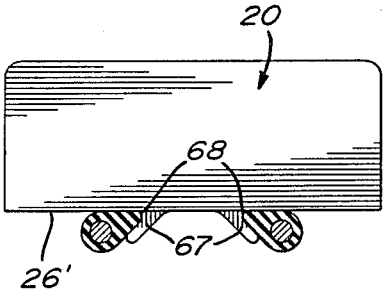
FIG. 14 is a rear view of the housing showing the hinge clamp in cross-section.

Referring now to FIGS. 12, 13 and 14, there is shown another embodiment of a hinge clamp. As herein shown, the hinge clamp 60 is an adjustably and detachably secured clamp which is constituted by opposed clamp members 61 and 61' which are resiliently connected together adjacent opposed free end portions thereof. As herein shown, the clamp member 61 and 61' are formed of u-shaped metal rods each having opposed parallel arms 62 and 62' with a right angle end portion 63 and 63' extending parallel to one another and transverse to the planar axis of the u-shaped rods. Each of the parallel arms 62 and 62' are interconnected by an intermediate transverse rod portion 63 and 63', respectively.

As can be seen in the right angle end portions 63 and 63' have free ends 64 and 64'. The opposed u-shaped metal clamp members are secured together with their right angle end portions 63 and 63' axially aligned and their free ends 64 and 64' spaced apart and retained in this configuration by a resilient covering material 65 which is disposed entirely about the rods and bridging the gap between the free end 64 and 64'. Thus, the spacing between the rod end 64 and 64' can be varied by applying pressure in the direction of the arrows 66 and thus providing adjustability to sound boxes of musical instruments having different thicknesses. This flexible material 65 may be a rubber material.

As shown in FIG. 14, the housing 20 is provided with a retention means in the form of angled flanges 67 depending from the lower face 26' of the housing 20 whereby to define opposed grooves 68 into which the upper one of the u-shaped metal rod, namely the clamp member 62 may be engaged to provide a downward pressure on the housing 20 in the direction of arrows 66. The length of the side arm 62 also provides for axial adjustability in the direction of arrows 69, (see FIG. 13) whereby to accommodate music boxes which have varying spacing between the rear wall 11' of the sound box and the rear edge 13' of the bridge piece 13. This varying distance indicated by the letter "x" in FIG. 13. Accordingly, the clamp member 60 provides a flexible connection to accommodate sound boxes of varying sizes in the portion rearwardly of the bridge piece 13 and varying thicknesses in the rearward portion of the sound box.

Figure 15:
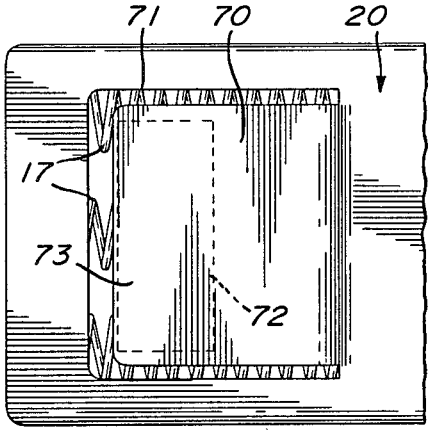
FIG. 15 is a fragmented top view of the housing showing the flexible clamping wall portion.
Figure 16:
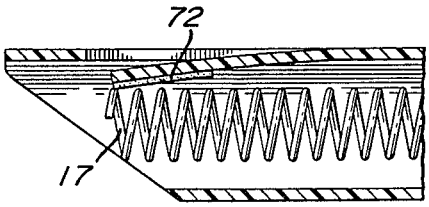
FIG. 16 is a fragmented side section view showing the operation of the flexible wall clamping means.

Referring now to FIGS. 15 and 16, there is shown in the construction of clamping associated with the housing 20 when engaging a portion of the springs 17 to arrest the vibration thereof in order to stop the reverberation effect of the springs. This clamping means as herein shown is constituted by a flexible wall portion 70 formed in the top wall of the housing 20 by forming a u-shaped slip 71 in the top wall. A clamping material, such as a felt 72 is secured to an inside face portion of the flexible wall portion 70 for abuting against the springs 17, as shown in FIG. 16. Accordingly, by pressing on the free end 73 of the flexible wall portion 70, the wall is hinged inwardly and abuts against the springs to arrest any vibration therein. Of course, the flexible wall portion 70 is of sufficient witdh to abut all of the springs that may be contained within the housing 20.

Although, the reverberation device 10 as herein described is shown attached to a guitar, the device may also be used with other string instruments such as violins, mandolins, basses, etc.

It is within the ambit of the present invention to cover any other obvious modifications of the examples of the preferred embodiment described therein, provided such modifications fall within the scope of the appended claims.

We claim:

1. A sound reverberator device for detachable connection to the strings of a string musical instrument having strings tensioned over a bridge piece connected to a top wall of the sound box of said instrument, said reverberator comprising one or more metal springs secured at a rear to a spring support, a metallic attachment member secured to a free end of said spring, said attachment member has string engaging means for engaging said strings of said musical instrument, said attachment member further having a bridge abutment portion for contact with said bridge piece, and means to tension said spring with said attachment member connected to said strings whereby vibrations imparted to said strings will be transmitted to said bridge piece and said associated spring; said spring being vibrated by said associated string transmits its vibrations to said sound box through said bridge piece whereby to modify the tonality of the sound generated by said sound box as a result of setting the strings in vibration.

2. A sound reverberator device as claimed in claim 1 wherein there are two or more metal springs secured side-by-side, said spring engaging means engaging a predetermined number of strings in association with respective ones of said springs.

3. A sound reverberator device as claimed in claim 2 wherein there are three of said springs, said spring engaging means engaging a respective pairs of said strings in association with respective ones of said springs.

4. A sound reverberator device as claimed in claim 3 wherein said attachment member is an integrally formed member, said string engaging means being constituted by two spaced-apart contact fingers disposable in pressure contact under a pair of associated strings when said reverberator device is secured in its position of use over said sound box.

5. A sound reverberator device as claimed in claim 4 wherein said attachment member is pivotally secured to said springs.

6. A sound reverberator device as claimed in claim 4 wherein said bridge abutment portion extends rearwardly of said contact fingers and is dimensioned to fit between a pair of said strings, and a spring connecting arm extending above said bridge abutment portion for connection to said springs.

7. A sound reverberator device as claimed in claim 6 wherein said string attachment member has a unitary spring connecting flange to which said springs are connected at an end in spaced relationship, there being three of said spring connecting arm formed integral with said flange and depending therefrom in a spaced-apart relationship, said bridge abutment portion being formed in a bottom edge of each said three connecting arms and extending forwardly thereof, said pair of contact fingers being formed integrally with each said bridge abutment portion adjacent a free end thereof, each finger of said pair of fingers extending on a respective one of opposed sides of said bridge abutment portion.

8. A sound reverberator device as claimed in claim 6 wherein said string attachment member is a unitary generally u-shaped member having opposed side arms, and a top intermediate integral arm portion, said contact finger being formed in a forward free end edge portion of each side arm by an outwardly extending integral flange, a rear end edge portion of each side arm constituting said bridge abutment portion, said spring connecting arm being constituted by said side arms and top intermediate integral arm portion.

9. A sound reverberator device as claimed in claim 6 wherein said u-shape member is formed from a flat metal strip, and a hole centrally disposed in said intermediate integral arm portion for connection of a loop end of an associated one of said springs, and a connecting bar secured rearwardly of said loop ends to maintain said springs interconnected spaced apart with said u-shaped members equally spaced.

10. A sound reverberator device as claimed in claim 7 wherein said spring support comprises a housing having a bottom wall, side walls, a top wall and a rear end wall; said housing being open at a front end thereof, an elongated separating wall on opposed sides of a center one of said springs, said separating walls each having a retention means in a front edge thereof extending along a common plane, said spring connecting flange being retained across said retention slots by spring tension imparted thereto by said three springs.

11. A sound reverberator device as claimed in claim 9 wherein said spring support comprises a housing having a bottom wall, side walls, a top wall and a rear end wall; said housing being open at a front end thereof, an elongated separating wall on opposed sides of a center one of said springs, said separating walls each having a retention means in a front edge thereof extending along a common plane, said connecting bar being retained across said retention slots by spring tension imparted thereto by said three springs.

12. A sound reverberator device as claimed in claim 10 or 11 wherein said retention means is a retention slot in a front edge of said separating walls.

13. A sound reverberator device as claimed in claim 10 wherein said means to tension said springs comprises an abuting element depending from a forward portion of said bottom wall to abut against a rear edge of said bridge piece and maintain said bottom wall elevated from said top wall of said sound box, and a hinge clamp adjustably secured adjacent said rear wall to maintain said housing substantially horizontal above said top wall of said sound box with said springs stretched therein by the wedging action of said box on said abuting element.

14. A sound reverberator device as claimed in claim 11 wherein said means to tension said springs comprises an abuting element depending from a forward portion of said bottom wall to abut against a rear edge of said bridge piece and maintain said bottom wall elevated from said top wall of said sound box, and a clamp adjustably secured adjacent said rear wall to maintain said housing substantially horizontal above said top wall of said sound box with said springs stretched therein by the wedging action of said box about said abuting element.

15. A sound reverberator device as claimed in claim 13 or 14 wherein said bottom wall of said housing is provided with a rubber support pad for abuting said top wall of said sound box to prevent slippage of said housing and maintain it elevated above said top wall of said sound box.

16. A sound reverberator device as claimed in claim 13 or 14 wherein said abuting element is a pair of legs having a rubber cover at a free end thereof, said legs being angulated forwardly of said forward portion of said bottom wall.

17. A sound reverberator device as claimed in claim 13 or 14 wherein said bottom wall is provided with an opening in a respective corner thereof adjacent said rear end wall, a plurality of cavities formed in an inner surface of said side walls adjacent said rear end wall and said openings for removably receiving in a selected one of said cavities a hinge connecting end portion of a u-shape hinge clamp which constitutes said adjustable securement.

18. A sound reverberator device as claimed in claim 3 or 14 wherein said string attachment members depend forwardly from said open front end of said housing, said pairs of contact fingers being positioned between said pairs of strings and positioned transversely thereunder with said housing held with said open front end facing above said strings, said contact fingers being disposed in transverse frictional contact under respective pairs of strings and positioned adjacent a forward edge of said bridge piece by pulling said housing rearwardly of said bridge piece, said springs being pre-tensioned in said housing and further tensioned by placing said abuting element against a rear edge of said bridge piece and hinging said housing to lie over said top wall of said sound box, and securing said housing in that position by said hinge clamp.

19. A sound reverberator device as claim in claim 13 wherein said means to tension said springs is constituted by a displeacable spring connecting wall slidingly secured to said support and displaceable by means of a threaded bolt, said common end of said springs being secured to said connecting wall whereby the tension in said springs may be varied by rotating said threaded bolt.

20. A sound reverberator device as claimed in claim 1 wherein said spring support is a housing for said said one or more springs being attached to a rear end of said housing, and said housing being opened at a front end, said housing having one or more abuting element(s) depending thereunder in a forward portion thereof for wedging said housing behind said bridge piece to tension said one or more springs, and ahinge clamp adjustably and detachably secured to a rear portion of said housing to maintain said housing substantially horizontal above said top wall of said sound box with said springs stretched therein by the wedging action of said abuting element(s).

21. A sound reverberator device as claimed in claim 20 wherein said hinge clamp is constituted by opposed clamp members configures to attach to said rear portion of said housing and pressure biased under a rear edge portion of a bottom wall of said sound box, said clamp members being resiliently connected together adjacent opposed free ends thereof.

22. A sound reverberator device as claimed in claim 21 wherein said clamp members are u-shaped metal rods having opposed parallel arms with a right angle end portion extending parallel to one another and transverse to the planar axis of said u-shape rods, said right angle end portion having a free end, said opposed clamps being secured together with their right angle end portion axially aligned and their said fill ends spaced apart by a resilient covering material adhered about said clamp members and bridging the said spaced apart free ends to provide a stretching zone in the spaced apart region.

23. A sound reverberator device as claimed in claim 22 wherein said housing is provided with a retention means defining a groove into which an upper of one of said u-shape metal rods engage to axial adjustability for said housing, said other u-shaped metal rod engaging said rear edge portion of said bottom wall providing adjustability for sound boxes of different thicknesses.

24. A sound reverberator as claimed in claim 1 wherein said spring support is a housing for said one or more springs, and clamping means associated with said housing for engaging a portion of said one or more springs to arrest the vibration thereof when said clamping means is placed against said one or more springs.

25. A sound reverberator as claimed in claim 24 wherein said clamping means is a flexible wall portion of said housing disposed adjacent said one ormore spring(s) and displaceable against said spring(s), and a clamping material secured to an inside face portion of said flexible wall portion for abuting said spring(s).

* * * * *